US011069994B2

(12) United States Patent
Peterson et al.

(10) Patent No.: US 11,069,994 B2
(45) Date of Patent: Jul. 20, 2021

(54) ELECTRICAL CABLE ASSEMBLY, METHOD AND APPARATUS FOR MAKING SAME AND ELECTRICAL TERMINAL FOR SAME

(71) Applicant: Aptiv Technologies Limited, St. Michael (BB)

(72) Inventors: David R. Peterson, Aurora, OH (US); Jared Bilas, North Bloomfield, OH (US); Joseph Sudik, Jr., Niles, OH (US); Jonathan D. Weidner, Conneautville, PA (US); Sean P. Krompegel, Canfield, OH (US); Jesse Braun, Warren, OH (US)

(73) Assignee: APTIV TECHNOLOGIES LIMITED

( * ) Notice: Subject to any disclaimer, the term of this patent is extended or adjusted under 35 U.S.C. 154(b) by 147 days.

(21) Appl. No.: 16/363,235

(22) Filed: Mar. 25, 2019

(65) Prior Publication Data

US 2020/0313326 A1 Oct. 1, 2020

(51) Int. Cl.

| | |
|---|---|
| ***H01R 12/77*** | (2011.01) |
| ***H01B 7/08*** | (2006.01) |
| ***H01B 13/00*** | (2006.01) |
| ***H01R 4/02*** | (2006.01) |
| ***H01R 4/2429*** | (2018.01) |
| ***H01R 13/424*** | (2006.01) |
| ***H01R 43/02*** | (2006.01) |

(Continued)

(52) U.S. Cl.

CPC ..... *H01R 12/771* (2013.01); *H01B 7/0823* (2013.01); *H01B 13/0036* (2013.01);

(Continued)

(58) Field of Classification Search

CPC ..... H01R 12/771; H01B 7/0823

(Continued)

(56) References Cited

U.S. PATENT DOCUMENTS 4,125,311 A * 11/1978 Hoppe, Jr. ..... H01R 4/2466 439/400

4,130,332 A 12/1978 Asick et al.

(Continued)

FOREIGN PATENT DOCUMENTS

EP 1253684 A2 10/2002
WO 2001031748 A1 5/2001

OTHER PUBLICATIONS

Extended European Search Report for EP Application No. 20165520.6, dated Jun. 29, 2020.

*Primary Examiner* — Neil Abrams
(74) *Attorney, Agent, or Firm* — Billion & Armitage

(57) ABSTRACT

An electrical cable assembly is presented herein. The electrical cable assembly includes a multiconductor flat cable including a first and second electrically conductive wire arranged in a coplanar fashion with each other and encased within a planar dielectric structure. A slot is defined in the planar dielectric structure intermediate the first and second wires, thereby forming first wing features in the dielectric structure extending from the first wire and second wing features extending from the second wire. Exposed portions of the first and second wires extend beyond the first and second wing features. A method of forming the electrical cable assembly, an apparatus for forming the electrical cable assembly, and an electrical terminal configured for use in the electrical cable assembly is also presented. The wing features may include holes and the terminals may include prongs to be received in the holes.

12 Claims, 14 Drawing Sheets

(51) Int. Cl.
*H01R 43/20* (2006.01)
*H01R 43/28* (2006.01)

(52) U.S. Cl.
CPC ..... *H01R 4/023* (2013.01); *H01R 4/2429* (2013.01); *H01R 13/424* (2013.01); *H01R 43/02* (2013.01); *H01R 43/20* (2013.01); *H01R 43/28* (2013.01)

(58) Field of Classification Search
USPC ..... 439/492, 874, 422
See application file for complete search history.

(56) References Cited

U.S. PATENT DOCUMENTS

| | | | | |
|---|---|---|---|---|
| 5,314,361 | A * | 5/1994 | Ney | H01R 4/027 439/874 |
| 6,232,556 | B1 | 5/2001 | Daugherty et al. | |
| 6,280,241 | B2 | 8/2001 | Herlinger et al. | |
| 6,688,920 | B2 | 2/2004 | Lehner et al. | |
| 6,705,893 | B1 * | 3/2004 | Ko | H01R 12/714 439/497 |
| 7,462,062 | B2 * | 12/2008 | Kumakura | H01R 4/182 439/422 |
| 7,581,979 | B2 * | 9/2009 | Kumakura | H01R 4/185 174/117 FF |
| 8,721,361 | B2 * | 5/2014 | Wu | H01R 13/405 439/497 |
| 2002/0020545 | A1 * | 2/2002 | Suzuki | H01R 12/594 174/117 F |
| 2008/0214065 | A1 | 9/2008 | Kumakura | |
| 2018/0301832 | A1 | 10/2018 | Coakley | |
| 2020/0313326 | A1 * | 10/2020 | Peterson | B26D 3/14 |

* cited by examiner

ELECTRICAL CABLE ASSEMBLY, METHOD AND APPARATUS FOR MAKING SAME AND ELECTRICAL TERMINAL FOR SAME

TECHNICAL FIELD OF THE INVENTION

The invention generally relates to an electrical cable assembly, particularly to a flat electrical cable assembly.

BRIEF SUMMARY OF THE INVENTION

The present invention will now be described, by way of example with reference to the accompanying drawings, in which:

BRIEF DESCRIPTION OF THE SEVERAL VIEWS OF THE DRAWING

The present invention will now be described, by way of example with reference to the accompanying drawings, in which.

DETAILED DESCRIPTION OF THE INVENTION

Figure 1:
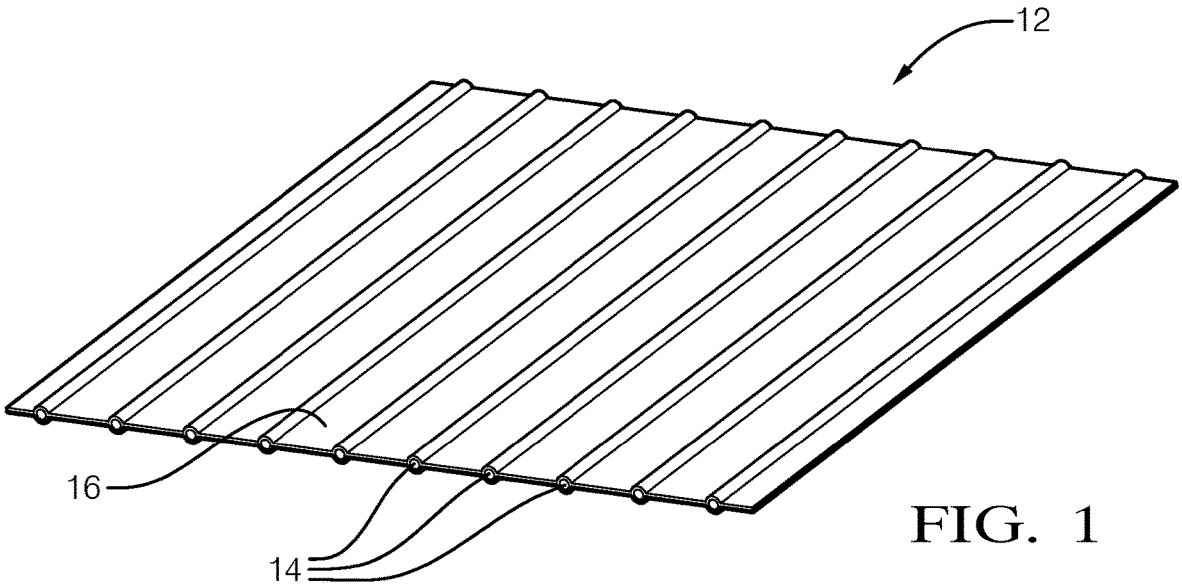
FIG. 1 is a perspective view of a multiconductor flat cable according to one embodiment of the invention.
Figure 2:
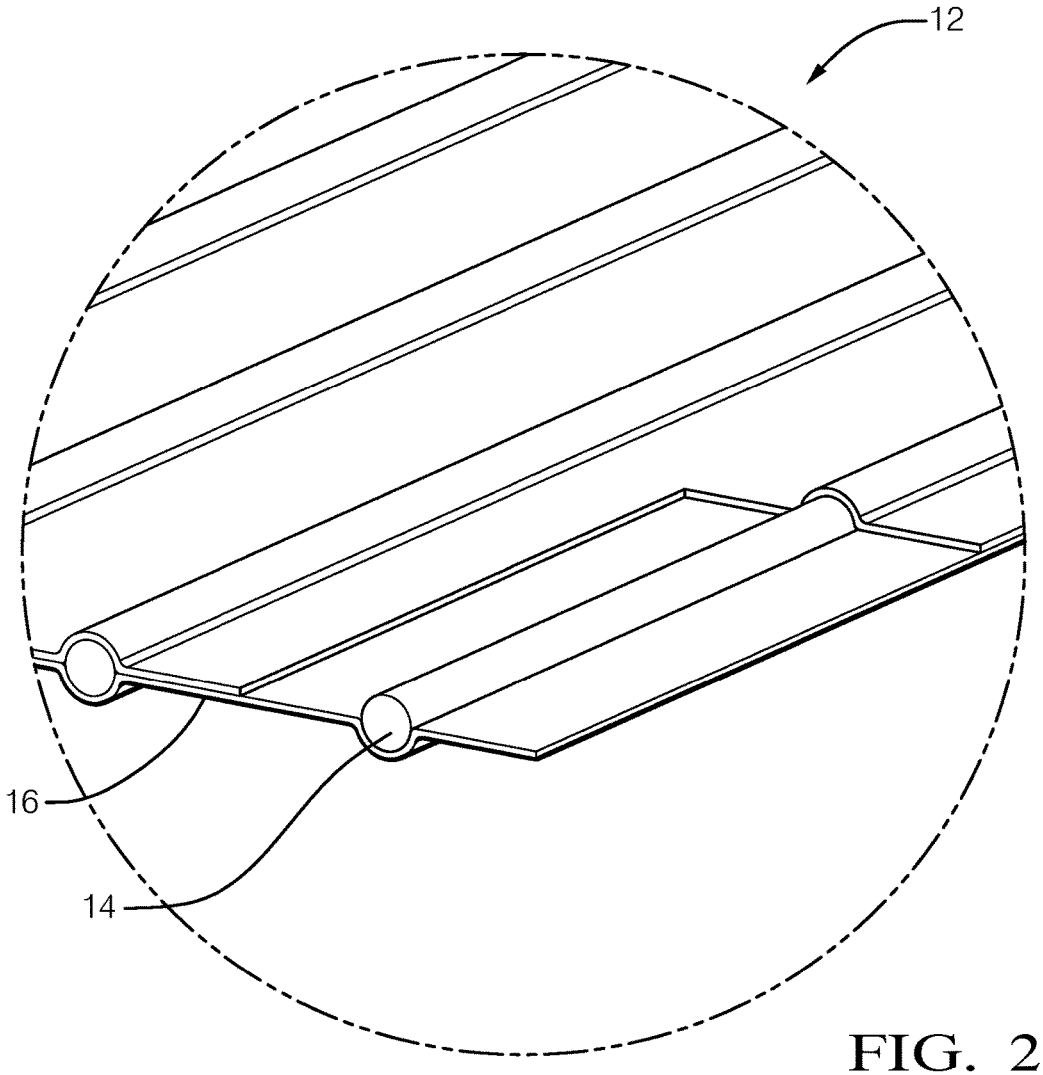
FIG. 2 is a cut away perspective of the flat cable of FIG. 1 according to one embodiment of the invention.
Figure 3:
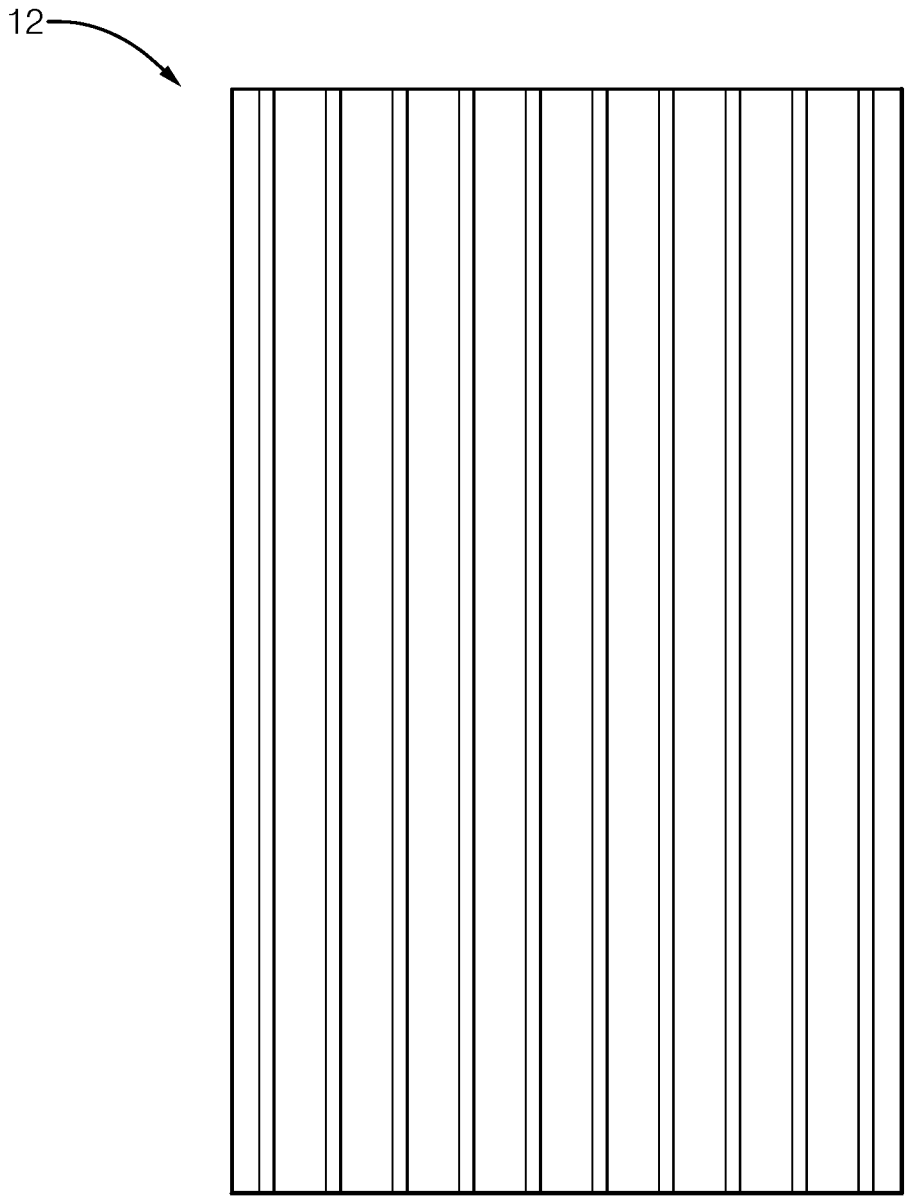
FIG. 3 is a top view of the flat cable of FIG. 1 according to one embodiment of the invention.

According to one embodiment of the invention, an electrical cable assembly is provided. The electrical cable assembly includes a multiconductor flat cable having a first electrically conductive wire and a second electrically conductive wire arranged in a coplanar fashion with each other. The first and second wires are encased within a planar dielectric structure. A slot is defined in the planar dielectric structure intermediate the first and second wires, thereby forming first wing features in the dielectric structure extending from the first wire and second wing features extending from the second wire. Exposed portions of the first and second wires extend beyond the first and second wing features.

An example embodiment having one or more features of the electrical cable assembly of the previous paragraph includes a connector having a housing formed of a dielectric material, a first electrical terminal and a second electrical both disposed within the housing. The exposed first wire is attached to the first terminal the exposed second wire is attached to the second terminal.

In an example embodiment having one or more features of the electrical cable assembly of the previous paragraph, the first and second terminals define prongs that are received within holes defined in portions of the first and second wing features, thereby retaining the first and seconds wires to the first and second terminals.

In an example embodiment having one or more features of the electrical cable assembly of the previous paragraph, the prongs are a pair of triangular prongs. The pair of triangular prongs may be a pair of right triangular prongs. A first prong in the pair of right triangular prongs may be arranged in reverse of a second prong in the pair of right triangular prongs.

In an example embodiment having one or more features of the electrical cable assembly of the previous paragraph, the second wire is shorter than the first wire. The first wire is bent such that it crosses over the second wire. In this embodiment, the first terminal is laterally offset from the first wire within the connector.

An example embodiment having one or more features of the electrical cable assembly of the previous paragraph includes a cover formed of dielectric material attached to the housing, thereby enclosing the first and second terminals.

In an example embodiment having one or more features of the electrical cable assembly of the previous paragraph, the first and second terminals each define a groove configured to receive the first and second wires and are sized to provide a friction fit between the first and second terminals and the first and second wires.

In an example embodiment having one or more features of the electrical cable assembly of the previous paragraph, the first and second wires are attached to the first and second terminals using a welding process.

An example embodiment having one or more features of the electrical cable assembly of the previous paragraph includes a connector comprising a housing formed of a dielectric material and an electrical terminal disposed within the housing. The first wire is bent such that the exposed first wire is aligned with the second exposed wire. The exposed second wire is attached to the electrical terminal. The exposed first wire is attached to the exposed second wire, thereby attaching the exposed first wire to the electrical terminal. In this embodiment of the electrical cable assembly, the electrical terminal may define prongs. A portion of the second wing features may be attached to the electrical terminal by inserting the prongs within holes defines in portions of the second wing features, thereby retaining the second wire to the electrical terminal. The portion of the first wing features may also be attached to the electrical terminal by inserting the prongs within the holes defined in portions of the first wing features, thereby retaining the first wire to the electrical terminal.

In an example embodiment having one or more features of the electrical cable assembly of the previous paragraph, the first and second wires have a substantially round cross section and wherein the first wire has a different cross sectional area than the second wire.

According to another embodiment of the invention, a method of forming an electrical cable assembly is provided. The method includes the steps of providing a multiconductor flat cable comprising a first and second electrically conductive wire arranged in a coplanar fashion with each other and encased within a planar dielectric structure, cutting a slot in the planar dielectric structure intermediate the first and second wires, thereby forming first wing features in the dielectric structure extending from the first wire and second wing features extending from the second wire, and removing portions of the dielectric structure from ends of the first and second wires, thereby exposing portions of the first and second wires, wherein portions of the first and second wing features remain.

An example embodiment having one or more features of the method of the previous paragraph includes the steps of providing a connector comprising a housing formed of a dielectric material, inserting first and second electrical terminals within the housing, and attaching the exposed first wire to the first terminal and attaching the exposed second wire to the second terminal.

In an example embodiment having one or more features of the method of the previous paragraph, the first and second terminals define prongs and the method further includes the step of attaching the portions of the first and second wing features to the first and second terminals by inserting the prongs within holes defined in the portions of the first and second wing features, thereby retaining the first and seconds wires to the first and second terminals.

In an example embodiment having one or more features of the method of the previous paragraph, the holes in the portions of the first and second wing features are formed by puncturing the portions of the first and second wing features using the prongs.

An example embodiment having one or more features of the method of the previous paragraph includes the steps of cutting the second wire such that it is are shorter than the first wire and bending an end potion of the first wire such that it crosses over the second wire. In this embodiment, the first terminal is laterally offset from the first wire within the connector.

An example embodiment having one or more features of the method of the previous paragraph includes the steps of providing a cover formed of dielectric material configured to attach to the housing and attaching the cover to the housing, thereby enclosing the first and second terminals.

In an example embodiment having one or more features of the method of the previous paragraph, the first and second terminals each define a groove configured to receive the first and second wires and sized to provide a friction fit between the first and second terminals and the first and second wires.

In an example embodiment having one or more features of the method of the previous paragraph, the first and second wires are attached to the first and second terminals using a welding process.

In an example embodiment having one or more features of the method of the previous paragraph, the step of inserting first and second electrical terminals within the housing is performed prior to the steps of attaching the exposed first wire to the first terminal and attaching the exposed second wire to the second terminal.

An example embodiment having one or more features of the method of the previous paragraph includes the steps of providing a connector comprising a housing formed of a dielectric material, inserting an electrical terminal within the housing, attaching the exposed second wire to the first terminal, cutting the second wire such that it is shorter than the first wire, bending the first wire such that the exposed first wire is aligned with the second exposed wire, and attaching the exposed first wire to the exposed second wire, thereby attaching the exposed first wire to the electrical terminal. According to this embodiment, the electrical terminal may define prongs and the method may further include the steps of attaching a portion of the second wing features to the electrical terminal by inserting the prongs within holes defines in the portions of the second wing features, thereby retaining the second wire to the electrical terminal and attaching the portion of the first wing features to the electrical terminal by inserting the prongs within the holes defined in the portions of the first wing features, thereby retaining the first wire to the electrical terminal.

According to yet another embodiment of the invention, an apparatus configured to manufacture an electrical cable assembly is provided. The apparatus includes a transport mechanism configured to move a multiconductor flat cable, from a spool and through the apparatus. The flat cable includes first and second electrically conductive wires arranged in a coplanar fashion with each other and encased within a planar dielectric structure. Th apparatus also includes a cutting mechanism configured to cut a slot in the planar dielectric structure intermediate the first and second wires, thereby forming first wing features in the dielectric structure extending from the first wire and second wing features extending from the second wire and a stripping mechanism configured to remove portions of the dielectric structure from ends of the first and second wires, thereby exposing portions of the first and second wires. The stripping mechanism is further configured to retain portions of the first and second wing features.

In an example embodiment having one or more features of the apparatus of the previous paragraph, the cutting mechanism is also configured to cut the second wire such that it is shorter than the first wire. The apparatus further comprises a bending mechanism that is configured to bend the third wire such that the exposed first wire is aligned with the second exposed wire or bend the first wire such that it crosses over the second wire.

In yet one more embodiment of the invention, an electrical terminal is provided. The electrical terminal includes a connection portion configured to interconnect with a corresponding mating terminal, a wire attachment portion configured to receive a wire cable, and an insulation attachment portion defining a pair of triangular prongs arranged so as to receive the wire cable between the pair of triangular prongs, wherein the pair of triangular prongs are configured to puncture through a dielectric structure surrounding the wire cable and create holes in the dielectric structure in which the pair of triangular prongs are received.

In an example embodiment having one or more features of the electrical terminal of the previous paragraph, the electrical terminal defines a groove in which the wire cable is received, The groove is sized to provide a friction fit between the electrical terminal and the wire cable.

In an example embodiment having one or more features of the electrical terminal of the previous paragraph, the pair of triangular prongs is a pair of right triangular prongs. A first prong in the pair of triangular prongs is arranged in reverse of a second prong in the pair of right triangular prongs.

Reference will now be made in detail to embodiments, examples of which are illustrated in the accompanying drawings. In the following detailed description, numerous specific details are set forth in order to provide a thorough understanding of the various described embodiments. However, it will be apparent to one of ordinary skill in the art that the various described embodiments may be practiced without these specific details. In other instances, well-known methods, procedures, components, circuits, and networks have not been described in detail so as not to unnecessarily obscure aspects of the embodiments.

As used herein reference numbers without letter suffixes may generically refer to a feature while reference numbers with suffixes may refer to specific features.

FIGS. 1-12 illustrate a non-limiting example of an electrical cable assembly 10 according to one or more embodiments of the invention. The electrical cable assembly 10 includes a multiconductor flat cable 12, shown in FIGS. 1-3, having a plurality of electrically conductive wires 14 arranged in a coplanar fashion and generally parallel to one another. The wires 14 are encased within a planar insulative structure 16 formed of a dielectric material, such as polyethylene (PE), polytetrafluoroethylene (PTFE), or perfluoroalkoxy alkane (PFA). The preceding list of dielectric materials is neither limiting nor exclusive. The planar insulative structure 16 may be formed using an extrusion process or may be formed by two separate insulative sheets that are attached to one another by an adhesive layer. In the illustrated example, the wires 14 have a round cross section and each of the wires 14 has the same diameter. Alternative embodiments may be envisioned in which at least one of the wires has a different diameter than the rest. Yet other alternative embodiments may be envisioned in which the wires have a square or rectangular cross section.

Figure 4:
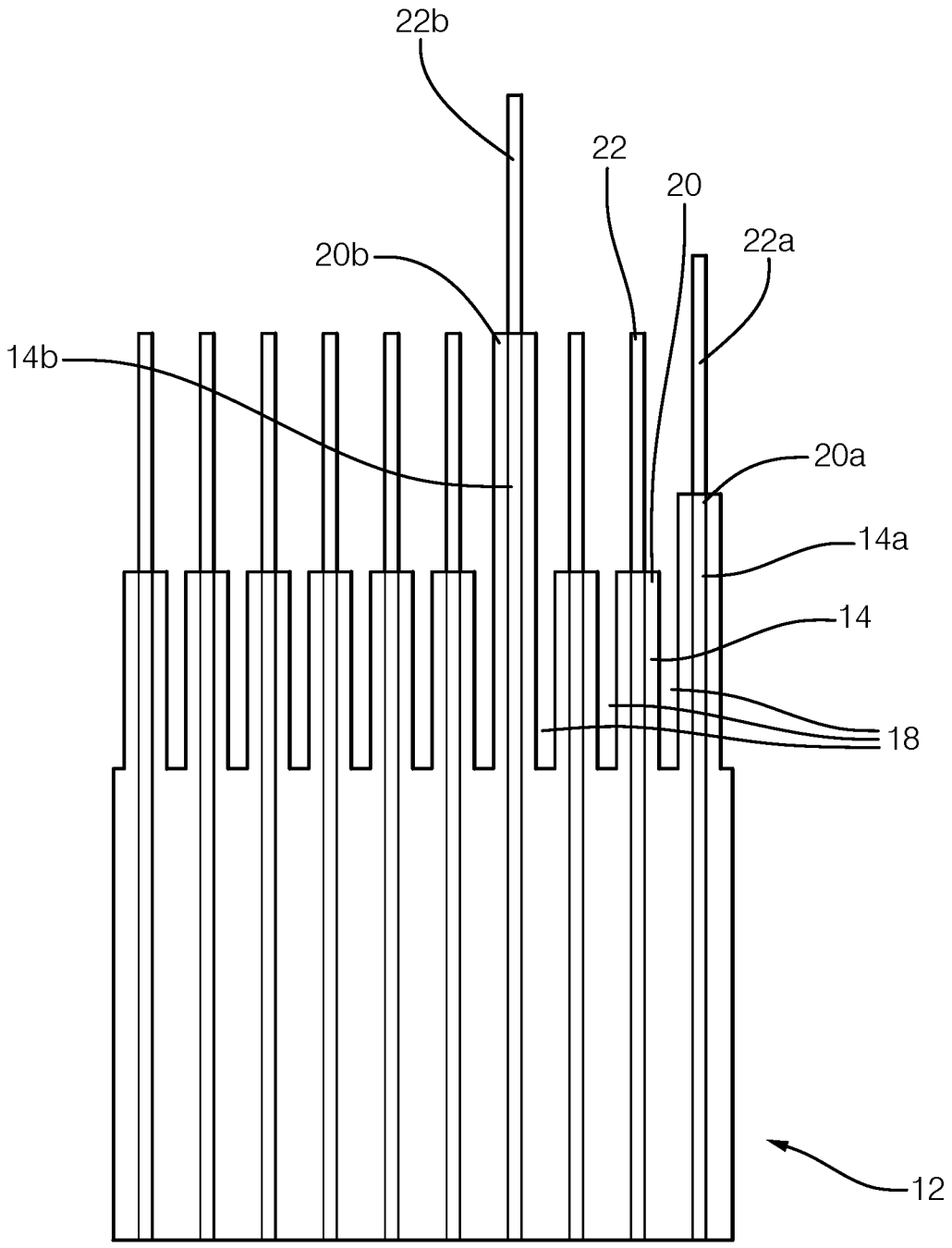
FIG. 4 is a top view of an electrical cable assembly formed from the flat cable of FIG. 1 according to one embodiment of the invention.

As illustrated in FIG. 4, slots 18 are cut in the planar insulative structure 16 between the wires 14 in an end section of the flat cable 12, thereby forming generally flat wing shaped features, hereinafter referred to as insulation wings 20, that extend from both sides of each wire 14. The remaining insulative structure 16 is totally removed, or stripped, from the distal ends of the wire 14, thereby providing exposed wire portions 22 extending beyond the insulation wings 20. As further shown in FIG. 4, some of the wires 14 may be cut to a different length than other wires 14. The slots 18 and wires 14 may be cut by a blade cutter, a blanking cutter, or a laser cutter. The preceding list of cutting means is neither limiting nor exclusive.

Figure 5:
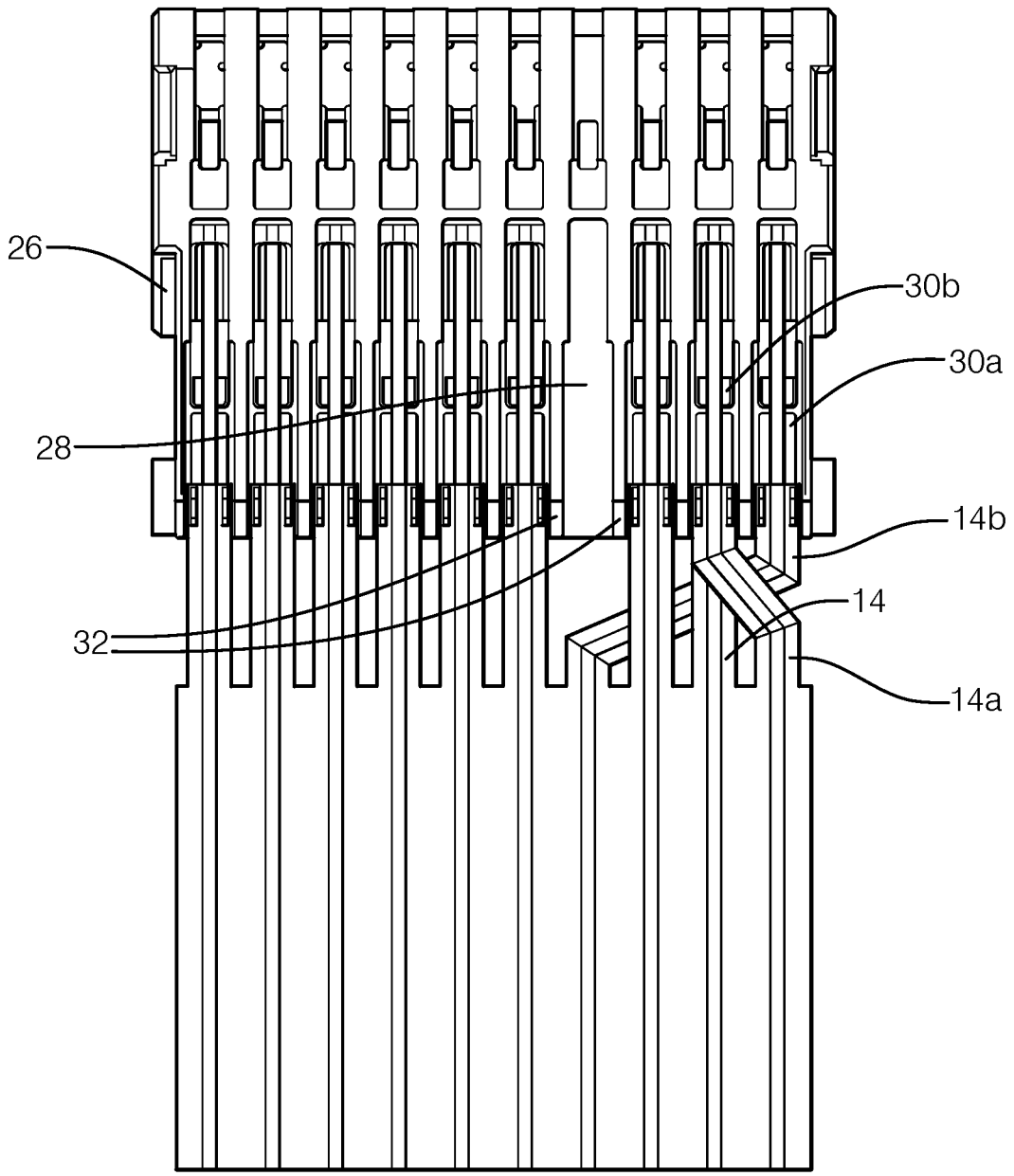
FIG. 5 is a top view of the electrical cable assembly of FIG. 4 interconnected with a connector having electrical terminals according to one embodiment of the invention.
Figure 6:
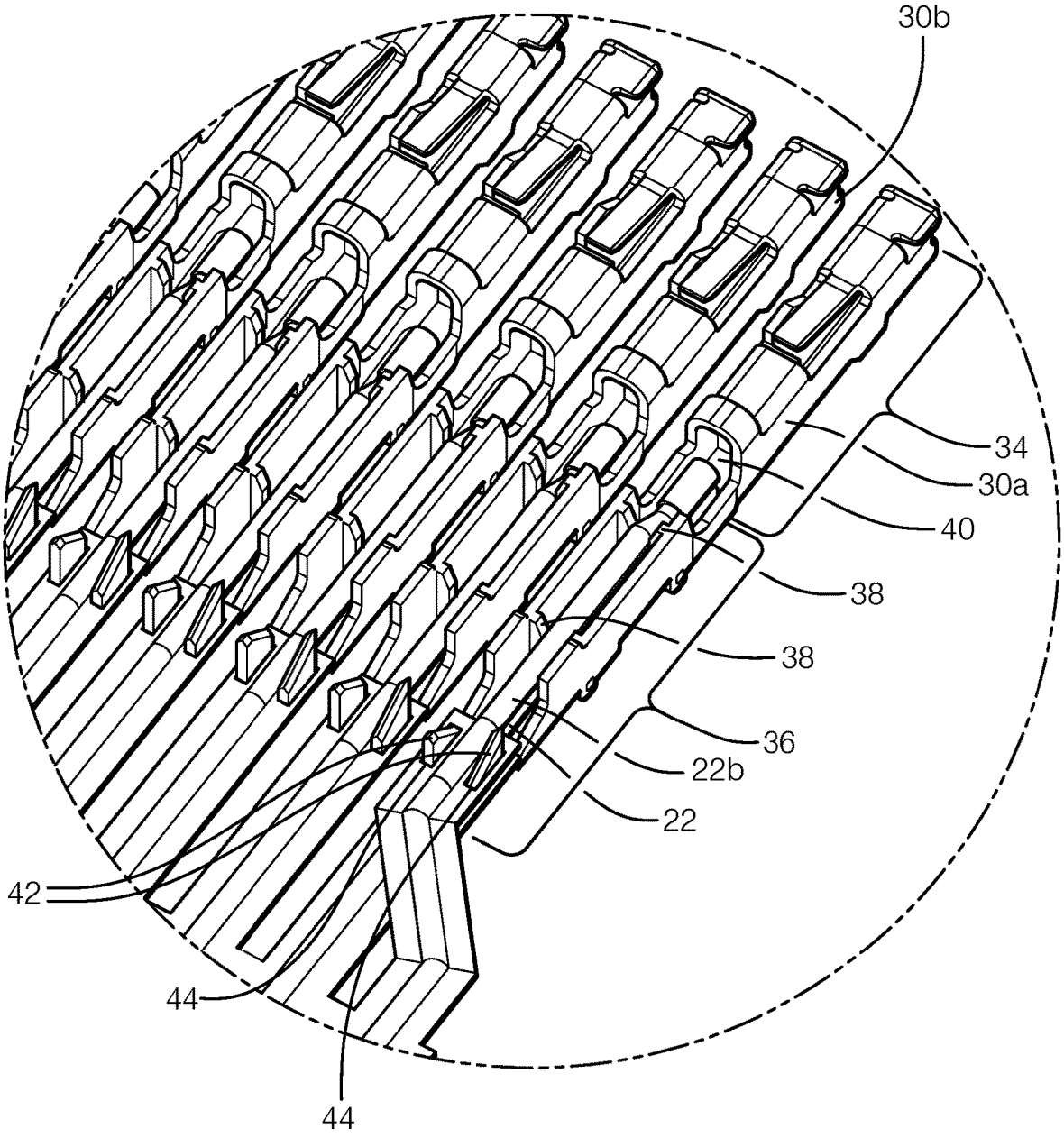
FIG. 6 is a close-up perspective view of the interface between the flat cable and the electrical terminals according to one embodiment of the invention.

As illustrated in FIG. 5, the electrical cable assembly 10 further includes a connector 24 having a housing 26 formed of a dielectric material, such as polyamide (PA) or polybutylene terephthalate (PBT). The preceding list of dielectric materials is neither limiting nor exclusive. The housing 26 defines a plurality of longitudinal open channels 28 in which a plurality of electrical terminals 30 are disposed. The terminals 30 are secured within the channels 28 by an interference fit between walls 32 of the channels 28 and the terminals 30. As used herein, an interference fit (also known as a press fit or friction fit) is a fastening between two parts which is achieved by friction after the parts are pushed together, rather than by another means of fastening. Alternative embodiments may be envisioned in which the terminals are secured within the housing by other means, such as adhesives or retaining features defined within the housing. The preceding list of terminal retaining means is neither limiting nor exclusive. The wires 14 of the flat cable 12 are electrically and mechanically attached to the terminals 30 as shown in FIG. 6.

The terminals 30 have a connecting portion 34 configured to interconnect with a corresponding mating terminal (not shown) and an attachment portion 36 configured to attach the terminal 30 to a wire 14. The connecting portion 34 of the illustrated example terminal 30 is a female connecting portion 34 configured to receive a male connecting portion of the mating terminal. Other embodiments may be envisioned in which the connection portion is a male connection portion. In other alternative embodiments, the housing may include terminals having a mixture of different connection types.

Figure 7:
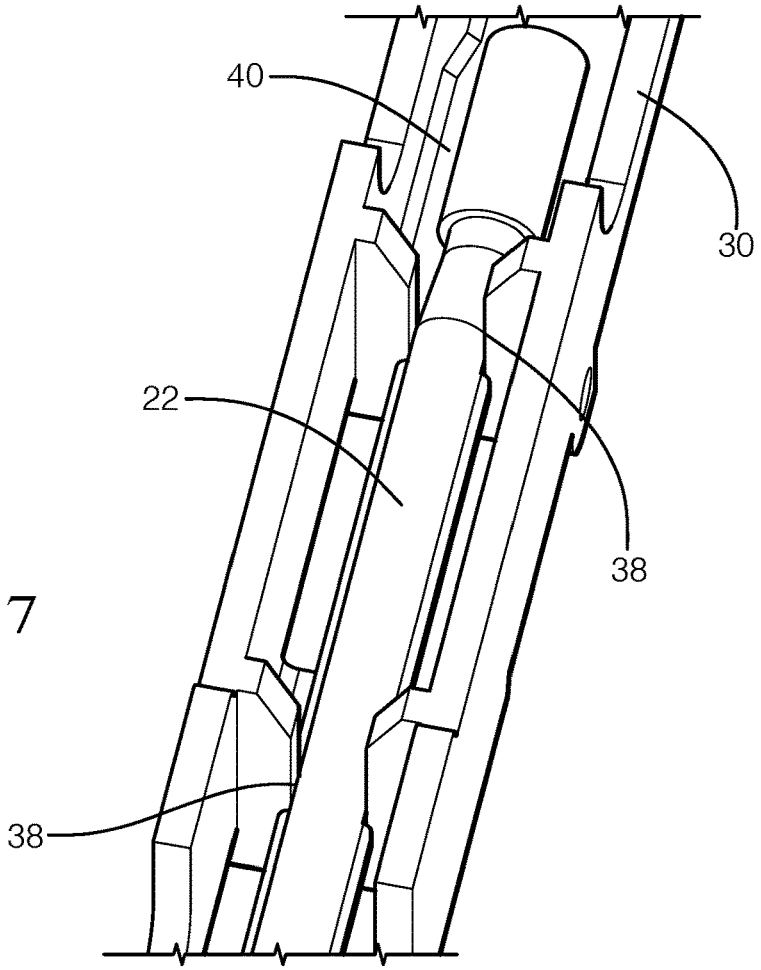
FIG. 7 is a close-up perspective view of the interface between an exposed wire of the flat cable and one of the electrical terminals according to one embodiment of the invention.
Figure 8:
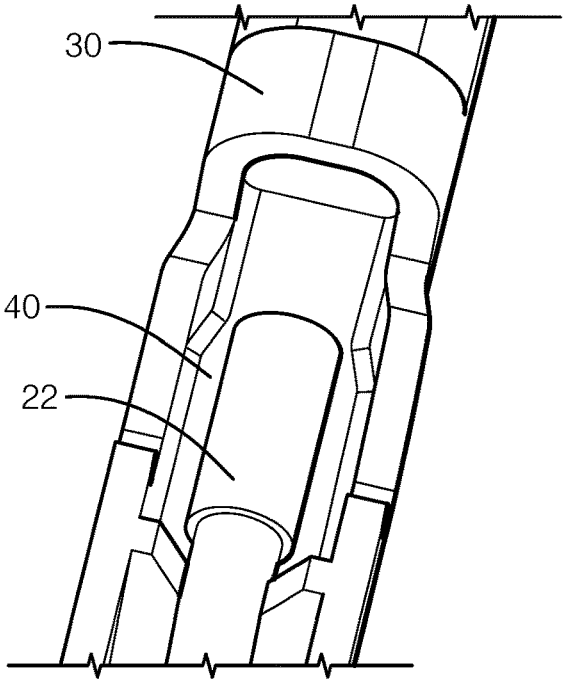
FIG. 8 is another close-up perspective view of the interface between the exposed wire of the flat cable and the electrical terminal of FIG. 7 according to one embodiment of the invention.

The exposed wire portions 22 are attached to the attachment portions 36 of the terminals 30 by two different means. As shown in FIG. 7, the terminals 30 each define a groove 38 that is configured to receive at least one exposed wire portion 22. This groove 38 is sized to provide an interference fit between the exposed wire portion 22 and the terminal 30, thereby mechanically and electrically connecting the exposed wire portion 22 to the terminal 30. As illustrated in FIG. 8, the attachment portion 36 defines a flat surface 40 to which the exposed wire portion 22 is attached to the flat surface 40 by a welding process, such as laser welding, sonic welding, or soldering, thereby mechanically and electrically connecting the wire 14 to the terminal 30. The preceding list of welding processes is neither limiting nor exclusive. The interference fit connection is primarily a mechanical connection between the exposed wire portion 22 and the terminal 30 and holds the exposed wire portion 22 in the desired location prior to and during the process of welding the exposed wire portion 22 to the terminal 30. The welded connection is primarily an electrical connection between the exposed wire portion 22 and the terminal 30.

As seen in FIG. 5, the attachment portions 36 of the terminal 30 are directly accessible when installed within the housing 26. This provides the benefit of being able to simultaneously and automatically connect each of the wires 14 in the flat cable 12 to the terminals 30 by pressing the wires 14 into the grooves 38 using a machine rather than being placed by a human assembler. This also provides the benefit of more easily accessing the interface between the flat surface 40 of the attachment portion 36 and the wire 14 with the welding means, e.g. a laser, a sonotode of a sonic welder, or a soldering iron. The preceding list of welding means is neither limiting nor exclusive.

Figure 9:
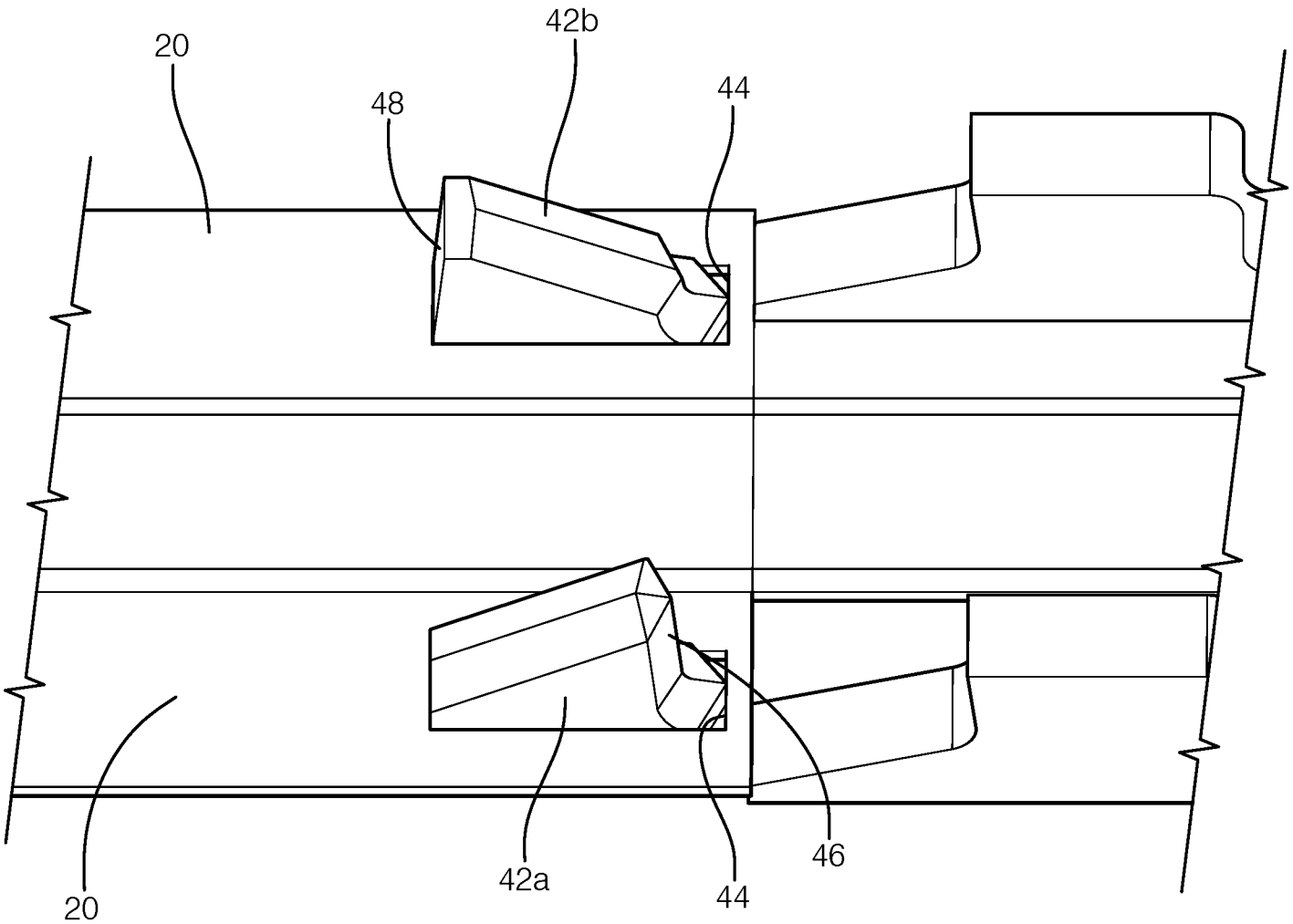
FIG. 9 is a close-up perspective view of the interface between insulation wings extending from a wire and a retention prongs of the electrical terminal according to one embodiment of the invention.

Returning now to FIG. 6, the terminals 30 define prongs 42 that are received within holes 44 defined in the insulation wings 20. These prongs 42 are configured to enhance retention of the wires 14 to the terminals 30. As best shown in FIG. 9, the prongs 42 are a pair of right triangular prongs 42. As can be seen in FIG. 9, one prong 42*a* in the pair of right triangular prongs 42 is arranged in opposition or in reverse of the other prong 42*b* in the pair of right triangular prongs 42. This arrangement of the prongs 42 is configured to limit longitudinal movement of the wire 14 in relation to the terminal 30 because rearward movement of the insulation wing is limited by the forward vertical surface 46 of the prong 42*a* and forward movement of the insulation wing is limited by the rearward vertical surface 48 of the prong 42*b*. As used herein, forward indicates a location closer to the connecting portion 34 and rearward indicates a location farther from the connecting portion 34. The triangular shape of the prongs 42 allows the prongs 42 to pierce the insulation wing, thereby forming the holes 44 in the insulation wings 20. Alternative embodiments may be envisioned in which the holes are formed in the insulation wings prior to the prongs being received in the holes using a cutting process using a blade cutter, a blanking cutter, or a laser cutter. The preceding list of cutting means is neither limiting nor exclusive. Alternative embodiments may be envisioned in which the prongs have different shapes, e.g. conical, cylindrical, or a rectangular prismatic. The preceding list of prong shapes is neither limiting nor exclusive.

FIG. 4 shows that several of the wires 14*a*, 14*b* are longer than the other wires 14. As shown in FIG. 5, these longer wires 14*a*, 14*b* are bent such that the first exposed wire portion 22*a*, 22*b* are connected with a terminal 30*a*, 30*b* that is laterally offset from the main portion of the wires 14*a*, 14*b*. As shown in FIG. 5, a wire 14*a* is bent such that an exposed wire portion 22*a* of the wire 14*a* is aligned with an exposed wire portion 22 of wire 14 that is adjacent the wire 14*a* which is attached to a terminal 30*b* that is longitudinally aligned with the wire 14. The exposed wire portion 22*a* is disposed within the groove 38 of the terminal 30*b* and the exposed wire portion 22*a* is welded to the exposed wire portion 22, thereby forming a dual connection between the wires 14*a*, 14 and the terminal 30*b*. As further shown in FIG. 5, another wire 14*b* is bent such that is crosses over the wires 14, 14*a* and is attached to a terminal 30*a* that is longitudinally aligned with the wire 14*a*. The illustrated connection scheme provides the benefit of changing the circuit arrangement between ends of the cables, thereby allowing the same connector arrangement to accommodate different circuit configurations. The illustrated connection scheme is not limiting and other embodiments with different circuit arrangements may be envisioned.

Figure 10:
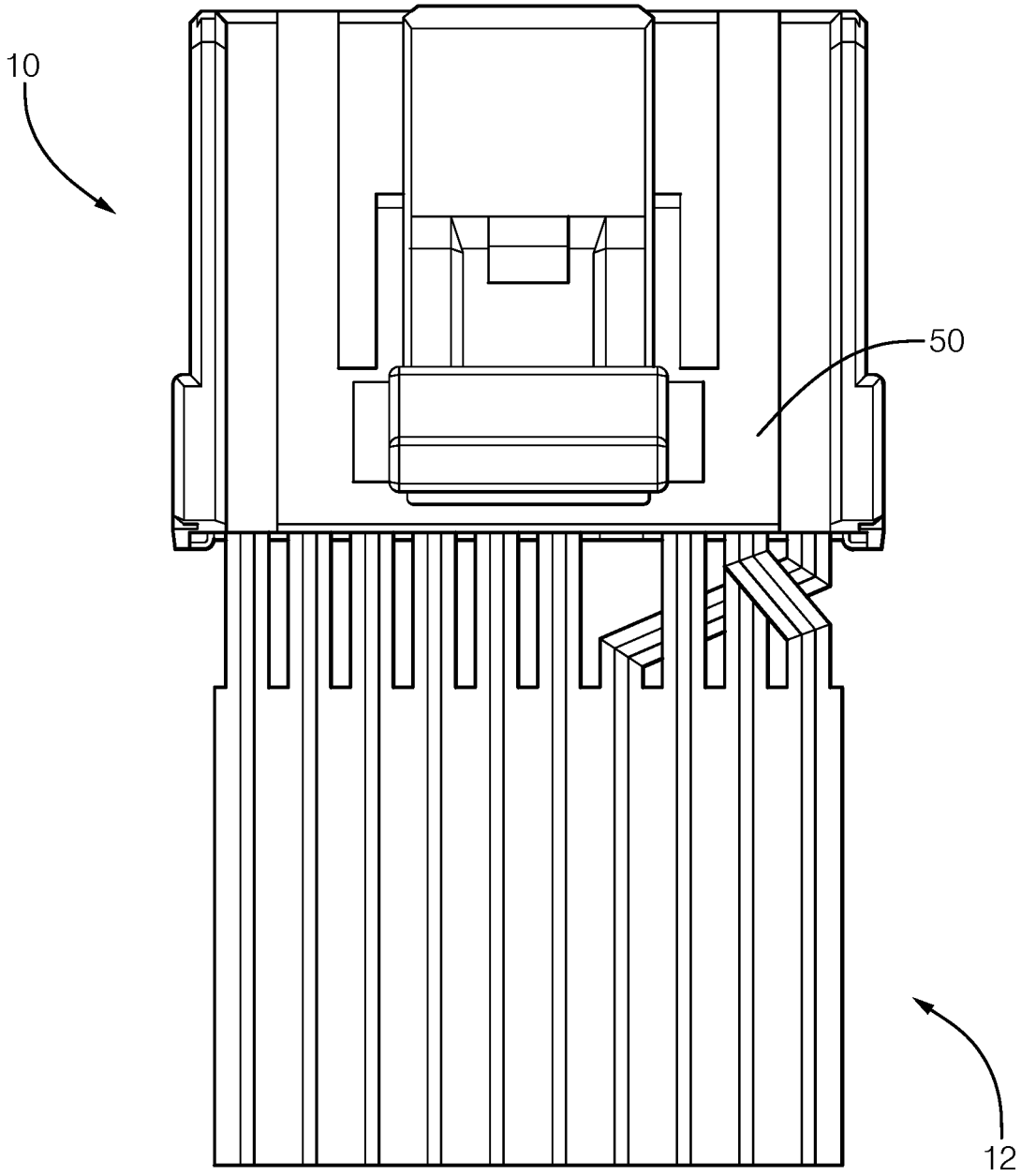
FIG. 10 is a top view of the electrical cable assembly with the connector having a cover enclosing the electrical terminals according to one embodiment of the invention.
Figure 11:
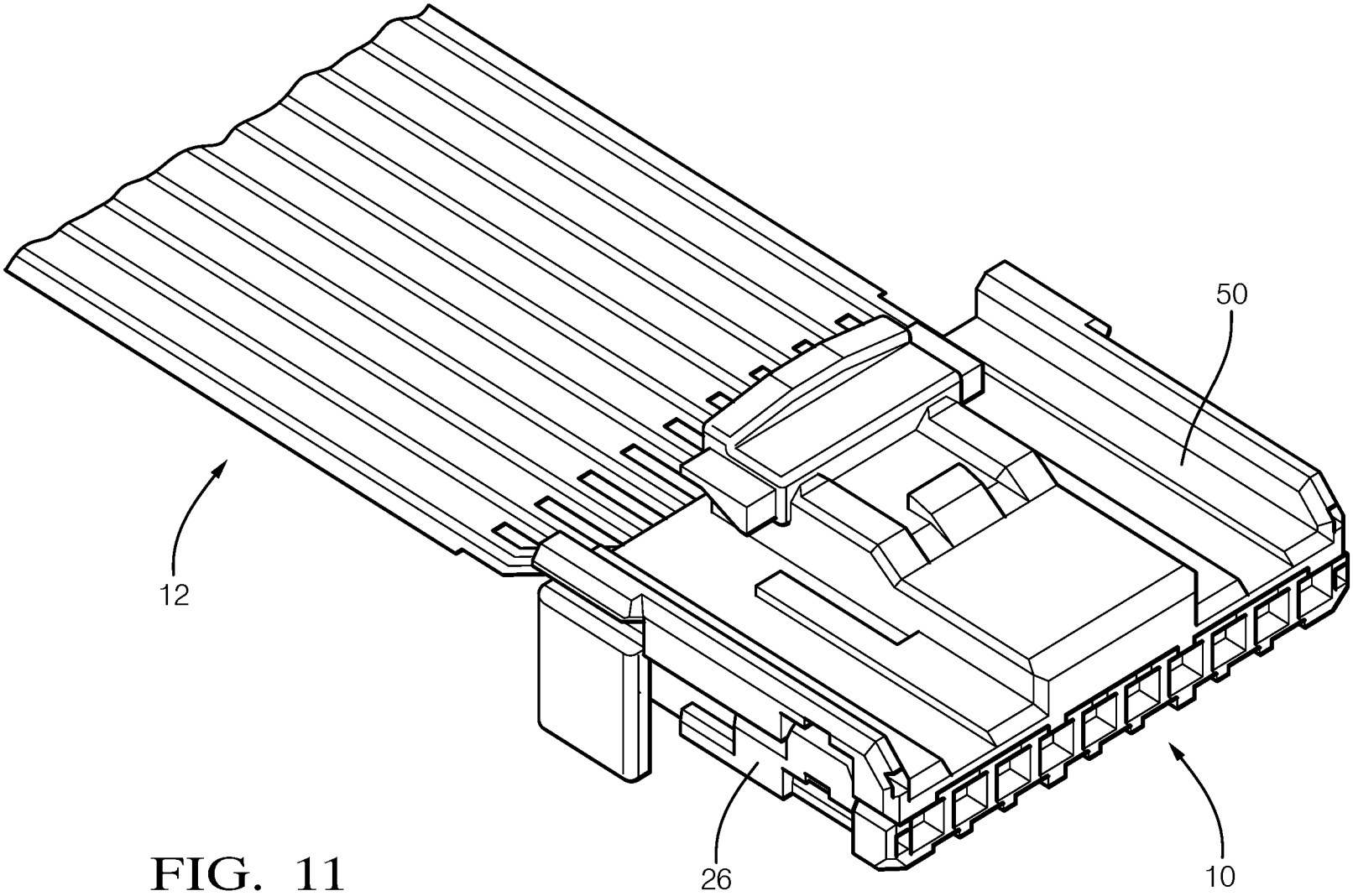
FIG. 11 is a perspective front view of the electrical cable assembly of interconnected with the connector having the cover enclosing the electrical terminals of FIG. 10 according to one embodiment of the invention.
Figure 12:
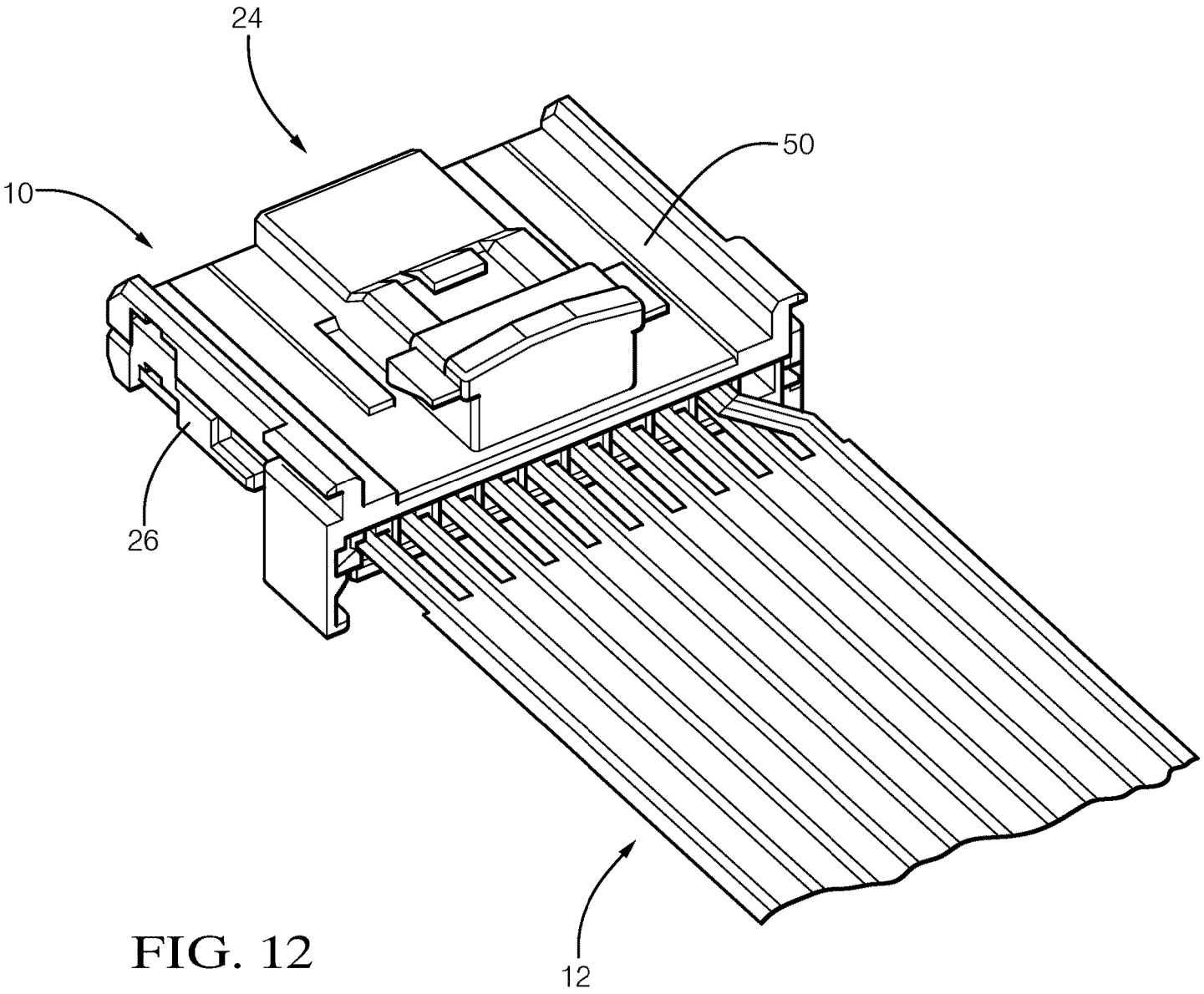
FIG. 12 is a perspective rear view of the electrical cable assembly of interconnected with the connector having the cover enclosing the electrical terminals of FIG. 10 according to one embodiment of the invention.

As illustrated in FIGS. 10-12, the electrical cable assembly 10 further includes a cover 50 that is formed of a dielectric material, e.g. PA or PBT, that is attached to the housing 26, thereby enclosing the terminals 30 within the connector 24. The preceding list of dielectric materials is neither limiting nor exclusive.

Figure 13:
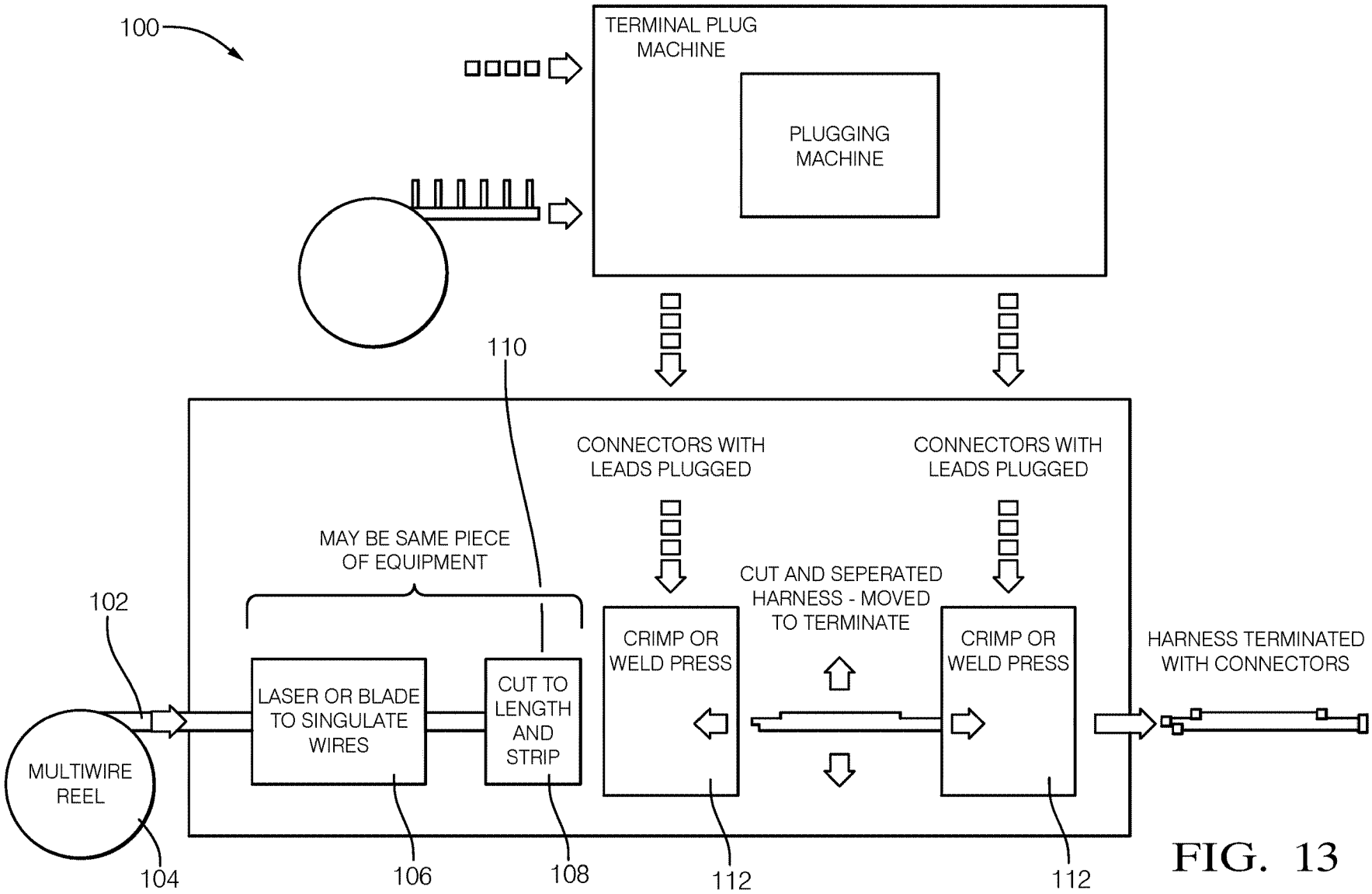
FIG. 13 is a schematic diagram of an apparatus configured to form an electrical cable assembly according to one embodiment of the invention.

FIG. 13 illustrates an apparatus 100 configured to manufacture an electrical cable assembly 10. The apparatus 100 includes a transport mechanism 102 that is configured to move a multiconductor flat cable 12 from a reel or spool 104 and through the apparatus 100. The flat cable 12 includes electrically conductive wires 14 that are arranged in a coplanar fashion with each other and encased within a planar dielectric structure. The apparatus 100 also includes a cutting mechanism 106 that is configured to cut a slot in the planar dielectric structure intermediate the wires 14, thereby forming insulation wings 20 in the dielectric structure extending from the wires 14. The cutting mechanism 106 may be configured to cut some wires 14 such that they are shorter than other wires 14*a*, 14*b* in the flat cable 12. The apparatus 100 also includes a stripping mechanism 108 that is configured to remove portions of the dielectric structure from ends of the wires 14, thereby creating exposed wire portions 22. The stripping mechanism 108 is further configured to retain portions of the insulation wings 20. The apparatus 100 further comprises a bending mechanism 110 that may be configured to bend one wire 14*a* such that the exposed wire portion 22*a* of that wire 14*a* is aligned with an exposed wire portion 22 of another wire 14 or may be configured to bend a wire 14*b* such that it crosses over the wire 14. The apparatus further includes an attaching mechanism 112 configured to attach the wires 14 to the terminals 30. The attaching mechanism 112 is configured to press the wires 14 into the terminals 30 and weld the wires 14 to the terminals 14. The apparatus 100 may include two attachment mechanisms 112 so the apparatus 100 can simultaneously terminate wires on both ends of the wire cable assembly 10.

Figure 14:
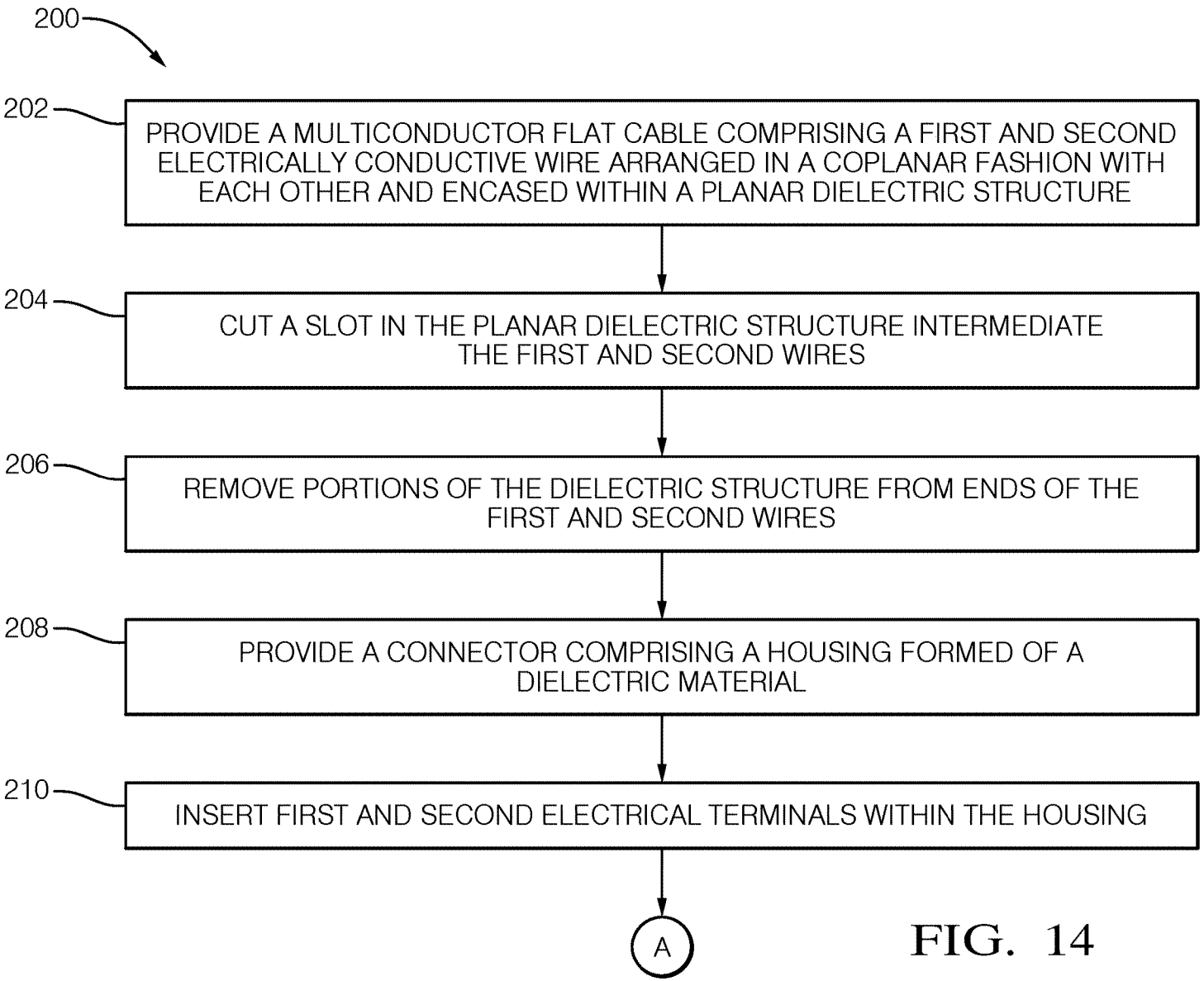
FIG. 14 is a flow chart of a method of forming an electrical cable assembly according to another embodiment of the invention.
Figure 14:
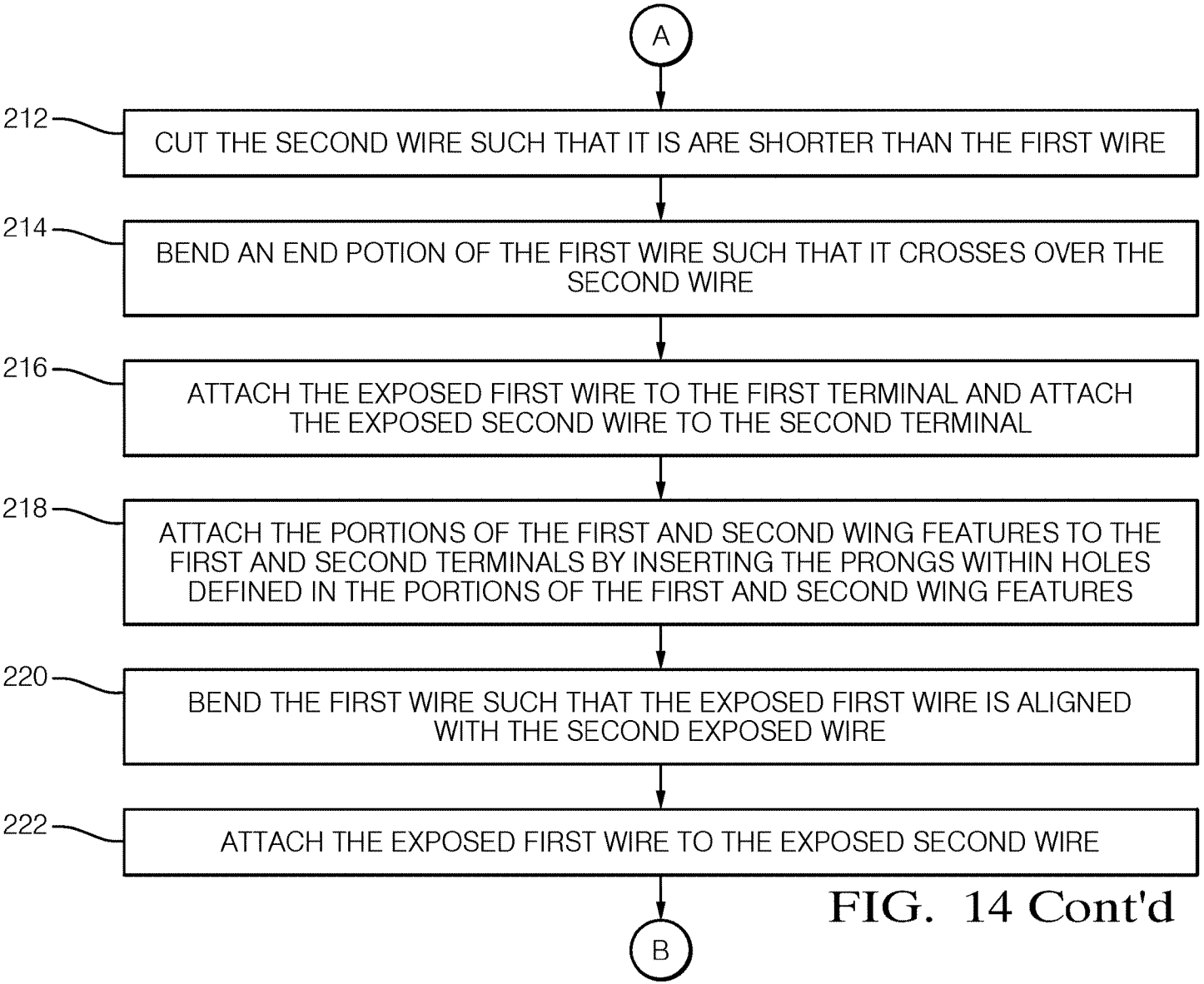
Figure 14:
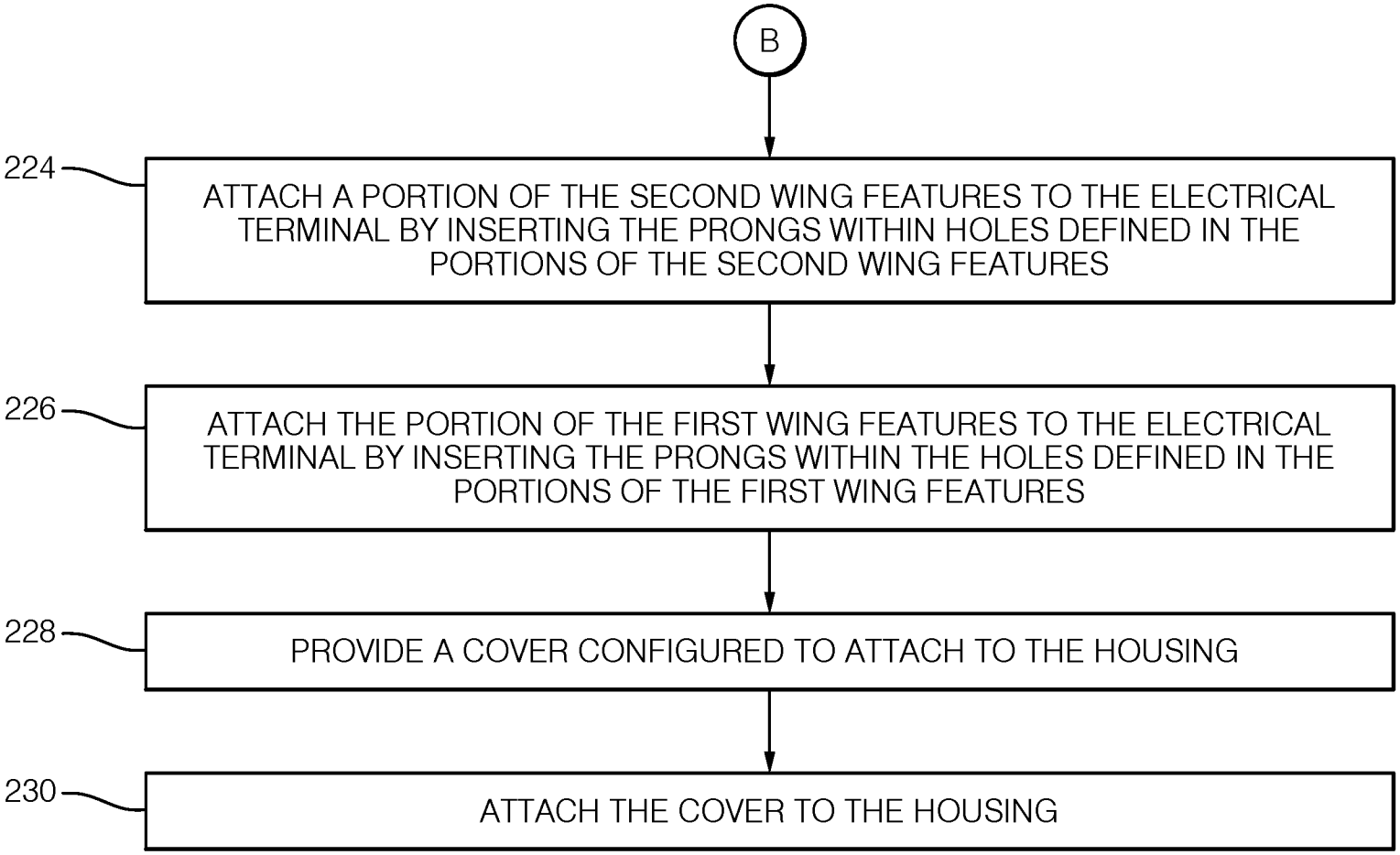

FIG. 14 illustrates a method of forming an electrical cable assembly 10. The method includes the following steps:

STEP 202, PROVIDE A MULTICONDUCTOR FLAT CABLE COMPRISING A FIRST AND SECOND ELECTRICALLY CONDUCTIVE WIRE ARRANGED IN A COPLANAR FASHION WITH EACH OTHER AND ENCASED WITHIN A PLANAR DIELECTRIC STRUCTURE, includes providing a multiconductor flat cable 12 comprising a electrically conductive wire 14, 14*a*, 14*b* arranged in a coplanar fashion with each other and encased within a planar insulative structure 16;

STEP 204, CUT A SLOT IN THE PLANAR DIELECTRIC STRUCTURE INTERMEDIATE THE FIRST AND SECOND WIRES, includes cutting a slot in the planar insulative structure 16 intermediate the wires 14, 14*a*, 14*b*, thereby forming 20, 20*a*, 20*b* in the planar insulative structure 16 extending from the wires 14, 14*a*, 14*b*;

STEP 206, REMOVE PORTIONS OF THE DIELECTRIC STRUCTURE FROM ENDS OF THE FIRST AND SECOND WIRES, includes removing portions of the dielectric structure from ends of the wires 14, 14*b*, 14*b*, thereby creating exposed wire portions 22, 22*a*, 22*b*, wherein portions of the insulation wings 20, 20*a*, 20*b* remain;

STEP 208, PROVIDE A CONNECTOR COMPRISING A HOUSING FORMED OF A DIELECTRIC MATERIAL, includes providing a connector 24 comprising a housing 26 formed of a dielectric material;

STEP 210, INSERT FIRST AND SECOND ELECTRICAL TERMINALS WITHIN THE HOUSING, includes inserting terminals 30*a*, 30*b* within channels 28 formed in the housing 26;

STEP 212, CUT THE SECOND WIRE SUCH THAT IT IS ARE SHORTER THAN THE FIRST WIRE, is an optional step that includes cutting the one wire 14 such that it is are shorter than another wire 14*a*, 14*b*;

STEP 214, BEND AN END POTION OF THE FIRST WIRE SUCH THAT IT CROSSES OVER THE SECOND WIRE, is an optional step that includes bending an end potion of the wire 14*b* such that it crosses over the wire 14;

STEP 216, ATTACH THE EXPOSED FIRST WIRE TO THE FIRST TERMINAL AND ATTACH THE EXPOSED SECOND WIRE TO THE SECOND TERMINAL, is an optional step that includes attaching the exposed wire portion 22*b* to one terminal 30*a* and attaching the other exposed wire portion 22 to another terminal 30*b*. The terminals 30*a*, 30*b* may each define a groove 38 that is configured to receive the exposed wire portions 22, 22*b* and sized to provide a friction fit between the terminals 30*a*, 30*b* and the exposed wire portions 22, 22*b*. The exposed wire portions 22, 22*b* may be further attached to the terminals 30*a*, 30*b* using a welding process. The terminal 30*a* is laterally offset from the wire 14*b* within the housing 26. STEP 210 is preferably performed prior to STEP 216;

STEP 218, ATTACH THE PORTIONS OF THE FIRST AND SECOND WING FEATURES TO THE FIRST AND SECOND TERMINALS BY INSERTING THE PRONGS WITHIN HOLES DEFINED IN THE PORTIONS OF THE FIRST AND SECOND WING FEATURES, is an optional step wherein the terminals 30*a,* 30*b* define prongs 42 and includes attaching the insulation wings 20, 20*b* to the terminals 30*a,* 30*b* by inserting the prongs 42 within holes 44 defined in the insulation wings 22, 22*b,* thereby retaining the wires 14, 14*b* to the terminals 30*a,* 30*b.* The holes 44 in the insulation wings 20, 20*b* may be formed by puncturing the insulation wings 20, 20*b* using the prongs 42;

STEP 220, BEND THE FIRST WIRE SUCH THAT THE EXPOSED FIRST WIRE IS ALIGNED WITH THE SECOND EXPOSED WIRE, is an optional step that includes bending a wire 14*a* such that the exposed wire portion 22*a* is aligned with the exposed wire portion 22;

STEP 222, ATTACH THE EXPOSED FIRST WIRE TO THE EXPOSED SECOND WIRE, is an optional step that includes attaching the exposed wire portion 22*b* to the exposed wire portion 22, thereby attaching the exposed wire portion 22*b* to the terminal 30*b;*

STEP 224, ATTACH A PORTION OF THE SECOND WING FEATURES TO THE ELECTRICAL TERMINAL BY INSERTING THE PRONGS WITHIN HOLES DEFINED IN THE PORTIONS OF THE SECOND WING FEATURES, is an optional step that includes attaching a portion of the insulation wings 20 to the terminal 30*b* by inserting the prongs 42 within holes 44 defined in the insulation wings 20, thereby retaining the wire 14 to the terminal 30*b;*

STEP 226, ATTACH THE PORTION OF THE FIRST WING FEATURES TO THE ELECTRICAL TERMINAL BY INSERTING THE PRONGS WITHIN THE HOLES DEFINED IN THE PORTIONS OF THE FIRST WING FEATURES, is an optional step that includes attaching the insulation wings 20*a* to the terminal 30*b* by inserting the prongs 42 within the holes 44 defined in the insulation wings 20*a,* thereby retaining the wire 14*a* to the terminal 30*b;*

STEP 228, PROVIDE A COVER CONFIGURED TO ATTACH TO THE HOUSING, includes providing a cover 50 formed of dielectric material configured to attach to the housing 26; and STEP 230, ATTACH THE COVER TO THE HOUSING, includes attaching the cover 50 to the housing 26, thereby enclosing the terminals 30*a,* 30*b.*

Accordingly, an electrical cable assembly 10 is presented. The electrical cable assembly 10 provides the benefits of easier packaging of the cable assembly due to the reduced thickness of the electrical cable assembly 10 compared to conventional automotive wiring assemblies. It also provides the benefit of ease of automated assembly due to the insertion of the terminals 30 within the housing 26 which allows all of the wires 14 to be connected the terminals 30 simultaneously by pressing the exposed wire portions 22 into the grooves 38 of the terminals 30. The terminal/wire interfaces are also more easily accessible by a welding device. This assembly also eliminates the needs for locking features in the housing 26 to retain the terminals 30 within the housing 26 and the problems created when these locking features are not properly engaged with the terminal 30. The electrical cable assembly 10 also avoids problems experienced during conventional insertion of a terminal attached to a small gauge wire into a connector housing caused by a low column strength of small gauge wires. An apparatus 100 for forming the electrical cable assembly 10, a method 200 of forming the electrical cable assembly 10, and an electrical terminal 30 configured for use in the electrical cable assembly 10 is also presented.

While this invention has been described in terms of the preferred embodiments thereof, it is not intended to be so limited, but rather only to the extent set forth in the claims that follow. For example, the above-described embodiments (and/or aspects thereof) may be used in combination with each other. In addition, many modifications may be made to configure a particular situation or material to the teachings of the invention without departing from its scope. Dimensions, types of materials, orientations of the various components, and the number and positions of the various components described herein are intended to define parameters of certain embodiments, and are by no means limiting and are merely prototypical embodiments.

Many other embodiments and modifications within the spirit and scope of the claims will be apparent to those of skill in the art upon reviewing the above description. The scope of the invention should, therefore, be determined with reference to the following claims, along with the full scope of equivalents to which such claims are entitled.

As used herein, 'one or more' includes a function being performed by one element, a function being performed by more than one element, e.g., in a distributed fashion, several functions being performed by one element, several functions being performed by several elements, or any combination of the above.

It will also be understood that, although the terms first, second, etc. are, in some instances, used herein to describe various elements, these elements should not be limited by these terms. These terms are only used to distinguish one element from another. For example, a first contact could be termed a second contact, and, similarly, a second contact could be termed a first contact, without departing from the scope of the various described embodiments. The first contact and the second contact are both contacts, but they are not the same contact.

The terminology used in the description of the various described embodiments herein is for the purpose of describing particular embodiments only and is not intended to be limiting. As used in the description of the various described embodiments and the appended claims, the singular forms "a", "an" and "the" are intended to include the plural forms as well, unless the context clearly indicates otherwise. It will also be understood that the term "and/or" as used herein refers to and encompasses any and all possible combinations of one or more of the associated listed items. It will be further understood that the terms "includes," "including," "comprises," and/or "comprising," when used in this specification, specify the presence of stated features, integers, steps, operations, elements, and/or components, but do not preclude the presence or addition of one or more other features, integers, steps, operations, elements, components, and/or groups thereof.

As used herein, the term "if" is, optionally, construed to mean "when" or "upon" or "in response to determining" or "in response to detecting," depending on the context. Similarly, the phrase "if it is determined" or "if [a stated condition or event] is detected" is, optionally, construed to mean "upon determining" or "in response to determining" or "upon detecting [the stated condition or event]" or "in response to detecting [the stated condition or event]," depending on the context.

Additionally, while terms of ordinance or orientation may be used herein these elements should not be limited by these terms. All terms of ordinance or orientation, unless stated otherwise, are used for purposes distinguishing one element from another, and do not denote any particular order, order of operations, direction or orientation unless stated otherwise.

We claim:

1. An electrical cable assembly, comprising:

a multiconductor flat cable including a first and second electrically conductive wire encased within a planar dielectric structure, wherein a slot is defined in the planar dielectric structure intermediate the first and second wires, thereby forming first wing features in the dielectric structure extending from the first wire and second wing features extending from the second wire and wherein exposed portions of the first and second wires extend beyond the first and second wing features; and first and second electrical terminals, wherein the exposed portion of the first wire is attached to the first terminal and the exposed portion of the second wire is attached to the second terminal, wherein the first and second terminals define prongs that are received within holes defined in portions of the first and second wing features.

2. The electrical cable assembly according to claim 1, further comprising:

a connector comprising a housing formed of a dielectric material; wherein the first and second electrical terminals are disposed within the housing.

3. The electrical cable assembly according to claim 1, wherein the prongs retain the first and seconds wires to the first and second terminals.

4. The electrical cable assembly according to claim 1, wherein the prongs are a pair of triangular prongs.

5. The electrical cable assembly according to claim 4, wherein the pair of triangular prongs is a pair of right triangular prongs and wherein a first prong in the pair of right triangular prongs is arranged in reverse of a second prong in the pair of right triangular prongs.

6. The electrical cable assembly according to claim 2, wherein the second wire is shorter than the first wire, wherein the first wire is bent such that it crosses over the second wire, and wherein the first terminal is laterally offset from the first wire within the connector.

7. The electrical cable assembly according to claim 2, further comprising:

a cover formed of dielectric material attached to the housing, thereby enclosing the first and second terminals.

8. The electrical cable assembly according to claim 2, wherein the first and second terminals each define a groove configured to receive the first and second wires and are sized to provide a friction fit between the first and second terminals and the first and second wires.

9. The electrical cable assembly according to claim 2, wherein the first and second wires are attached to the first and second terminals using a welding process.

10. The electrical cable assembly, comprising:

a multiconductor flat cable including a first and second electrically conductive wire encased within a planar dielectric structure, wherein a slot is defined in the planar dielectric structure intermediate the first and second wires, thereby forming first wing features in the dielectric structure extending from the first wire and second wing features extending from the second wire and wherein exposed portions of the first and second wires extend beyond the first and second wing features;

a connector comprising a housing formed of a dielectric material; and an electrical terminal disposed within the housing, wherein the first wire is bent such that the exposed first wire is aligned with the second exposed wire; wherein the exposed portion of the second wire is attached to the electrical terminal, and wherein the exposed portion of the first wire is attached to the exposed second wire, thereby attaching the exposed first wire to the electrical terminal.

11. The electrical cable assembly according to claim 10, wherein the electrical terminal defines prongs, wherein a portion of the second wing features is attached to the electrical terminal by inserting the prongs within holes defines in portions of the second wing features, thereby retaining the second wire to the electrical terminal, and wherein the portion of the first wing features is attached to the electrical terminal by inserting the prongs within the holes defined in portions of the first wing features, thereby retaining the first wire to the electrical terminal.

12. The electrical cable assembly according to claim 1, wherein the first and second wires have a substantially round cross section and wherein the first wire has a different cross-sectional area than the second wire.

* * * * *